US005325108A

United States Patent [19]

Salam

[11] Patent Number: 5,325,108

[45] Date of Patent: Jun. 28, 1994

[54] INFORMATION DISPLAYS

[75] Inventor: Hassan P. A. Salam, London, England

[73] Assignee: Unisplay S.A., London, England

[21] Appl. No.: 662,963

[22] Filed: Mar. 1, 1991

[30] Foreign Application Priority Data

Mar. 2, 1990 [GB] United Kingdom ..... 9004695
Oct. 26, 1990 [GB] United Kingdom ..... 9023325

[51] Int. Cl.[5] ..... G09G 3/16
[52] U.S. Cl. ..... 345/108; 345/111; 40/449
[58] Field of Search ..... 340/764, 815.26, 815.27, 340/815.29, 815.05, 815.32, 783, 735, 752, 756, 766, 715; 40/453, 467, 449, 465, 473, 474; 345/108, 109, 110, 111, 117, 143, 30, 31, 33

[56] References Cited

U.S. PATENT DOCUMENTS

| | | | |
|---|---|---|---|
| 4,069,480 | 1/1978 | Helwig | 340/764 |
| 4,154,872 | 5/1979 | Helwig | 340/815.26 |
| 4,314,244 | 2/1982 | Demke et al. | 340/748 |
| 4,612,537 | 9/1986 | Maltais et al. | 340/596 |
| 4,808,985 | 2/1989 | Tanuma et al. | 340/735 |
| 4,827,254 | 5/1989 | Nishiyama | 340/748 |
| 4,983,956 | 1/1991 | Salam | 340/783 |
| 5,050,325 | 9/1991 | Browne | 340/764 |

*Primary Examiner*—Alvin E. Oberley
*Assistant Examiner*—Xiao M. Wu
*Attorney, Agent, or Firm*—Watson, Cole Grindle & Watson

[57] ABSTRACT

A display system using a matrix of rotatable display elements is provided in which the optical states of the display elements can be read back to confirm that the matrix is portraying information correctly. The display system is arranged to automatically ameliorate the effect of detected non-operating display elements on the intelligibility of the message displayed.

16 Claims, 10 Drawing Sheets

| SENSE OF PULSE T3 | STATE OF DISPLAY ELEMENT | VALUE OF \|I\| AT T1 |
|---|---|---|
| "WRITE" | BRIGHT | IT1a |
| | DARK | IT1b |
| "ERASE" | BRIGHT | IT1b |
| | DARK | IT1a |

Fig.8.

| | DISPLAY ELEMENT IN BRIGHT STATE | DISPLAY ELEMENT IN DARK STATE |
|---|---|---|
| VALUE IN LOCATION 121 | IT1a | IT1b |
| VALUE IN LOCATION 123 | IT1b | IT1a |

Fig.9.

INFORMATION DISPLAYS

FIELD OF THE INVENTION

This invention concerns matrix displays for use, for example, as variable message signs on highways. A high degree of dependability is required for such signs. There can be a large number of them dispersed along a highway system all controlled from a central computer. It is desirable to have confirmation at the central computer that all matrixes are functioning correctly. It is also desirable that if there are any pixel faults in one of the matrixes that they are automatically corrected.

DESCRIPTION OF THE PRIOR ART

U.S. Pat. No. 4,156,872 describes a system designed to detect errors in the pixels of a matrix display. It is specifically concerned with matrix displays of the type in which each pixel comprises a display vane which is rotated into one of its two positions by the operation of a magnet, and is restricted to the detection of pixel errors generated by faulty switching of the magnetic pole pieces of the pixels. The above described system does not detect errors arising from the rotating optical part of a pixel failing to respond to the magnetization of the pole piece of the pixel.

SUMMARY OF THE INVENTION

It is an object of the present invention to provide a matrix display device of the type made up of a plurality of display elements or pixels, each one of the elements or pixels being operable to be in one of two possible states whereby information is displayed by the display device, in which the state of each display element or pixel can be determined. This data may be used to determine whether the display device is displaying information correctly. In a display device where the two states of each pixel are light and dark, for instance, it could be determined whether there are any pixels which are permanently light or permanently dark.

Thus this invention provides a matrix display device as outlined above which can be set to display certain information. Following the setting of the device the actual states of the display elements or pixels are read back from the device and compared with the desired states of the display elements in order to determine which display elements are not set to their correct state.

It is a further object of this invention to provide a matrix display device as outlined above in which the information corrupting effect of faulty display elements or pixels is minimised in order that the required information may be readably displayed.

Thus according to another aspect this invention provides a control system for a matrix display device as outlined above which has stored therein a plurality of acceptable alternative pixel patterns for each character which may be displayed on the device and which selects a particular one of the alternatives for each character to be displayed in order to minimise the detrimental effect of faulty display elements on the readability of the diplayed information.

There is further provided a method for displaying information on a matrix display device, said method comprising selecting from a set of alternative pixel patterns a particular pixel pattern for each character to be displayed and for selecting the exact position of each character on the display, said selections being made in order to remove or minimise the effect of faulty pixels in the display.

Yet another object of this invention is to prevent information which may be misinterpreted and hence misleading being displayed.

Further objects and advantages will become apparent from the following description of preferred embodiments of this invention.

BRIEF DESCRIPTION OF THE DRAWINGS

FIGS. 8 and 9 are tables useful for explaining the function of the apparatus of FIG. 6;

DESCRIPTION OF PREFERRED EMBODIMENTS

Figure 1A:
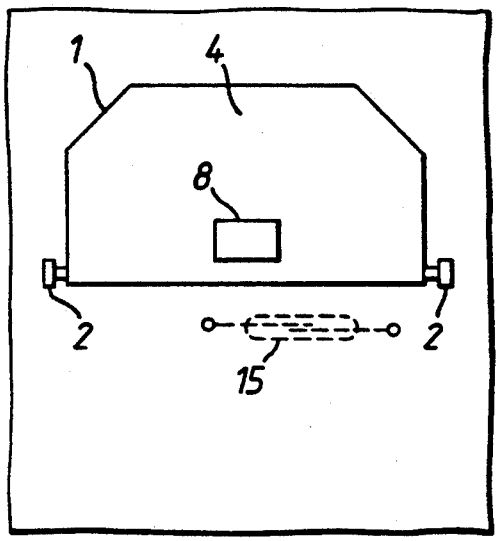
FIG. 1*a* shows a front view of a display element according to a first embodiment of this invention, the display element being in a first state.
Figure 1B:
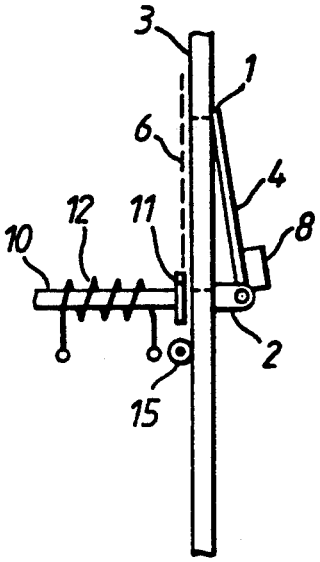
FIG. 1*b* is a side view of FIG. 1*a;*
Figure 1C:
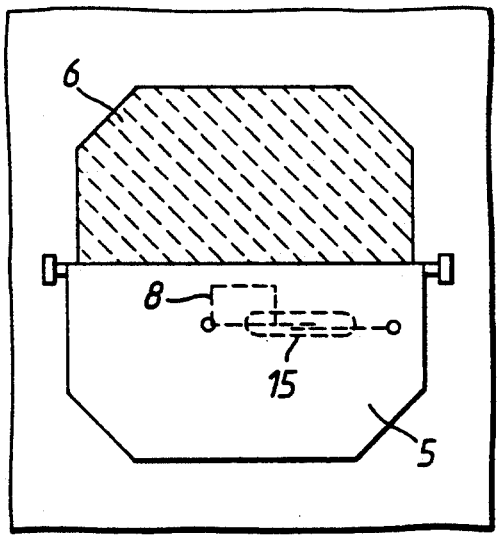
FIG. 1*c* shows a front view of the display element of FIG. 1*a*,, the display element being in a second state.
Figure 1D:
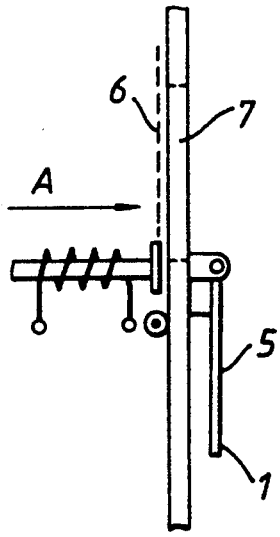
FIG. 1*d* is a side view of FIG. 1*c;*

Preferred embodiments of the invention are described with reference to a matrix using display elements of the type outlined in U.S. Pat. No. 4,163,332. The display element, shown in FIG. 1, comprises a vane 1 hinged by brackets 2 for rotation between a first position shown in FIGS. 1*a* and 1*b* in which a black face 4 of vane 1 is exposed to the viewer and a second brighter position shown in FIGS. 1*c* and *d* in which a reflective face 5 of vane 1 is exposed and at the same time a rear illuminated diffuser 6 is also exposed. Thus each display element can appear either bright or dark and a matrix display comprising a plurality of such elements may be used to display information.

Hinge brackets 2 are supported by a panel 3 which is common to and supports several display elements in a matrix display as mentioned above. Panel 3 includes a hole 7 corresponding to the position of diffuser 6 to allow the passage of back light as indicated by arrow A from a source not shown.

A permanent magnet 8 is mounted on rotatable vane 1 with its magnetic axis normal to the plane of the vane and its north pole facing the vane. An electromagnet 10 having a pole face 11 in close proximity to magnet 8 is used to rotate vane 1. When winding 12 of electromagnet 10 is energised so that pole face 11 is a north pole, vane 1 is urged due to the interaction between magnet 8 and electromagnet 10 to rotate clockwise into the bright state of FIGS. 1*c* and 1*d*. When winding 12 is energised so that pole face 11 is a south pole vane 1 is urged into the dark state of FIGS. 1*a* and 1*b*.

Mounted below the axis of rotation of vane 1 and behind panel 1 is a reed switch 15 which is so positioned that when the display element is in the bright state magnet 8 is close to the reed switch 15, and so turns it on, and when the display element is in the dark state magnet 8 is relatively remote from reed switch 15, and so it turns off.

Figure 2:
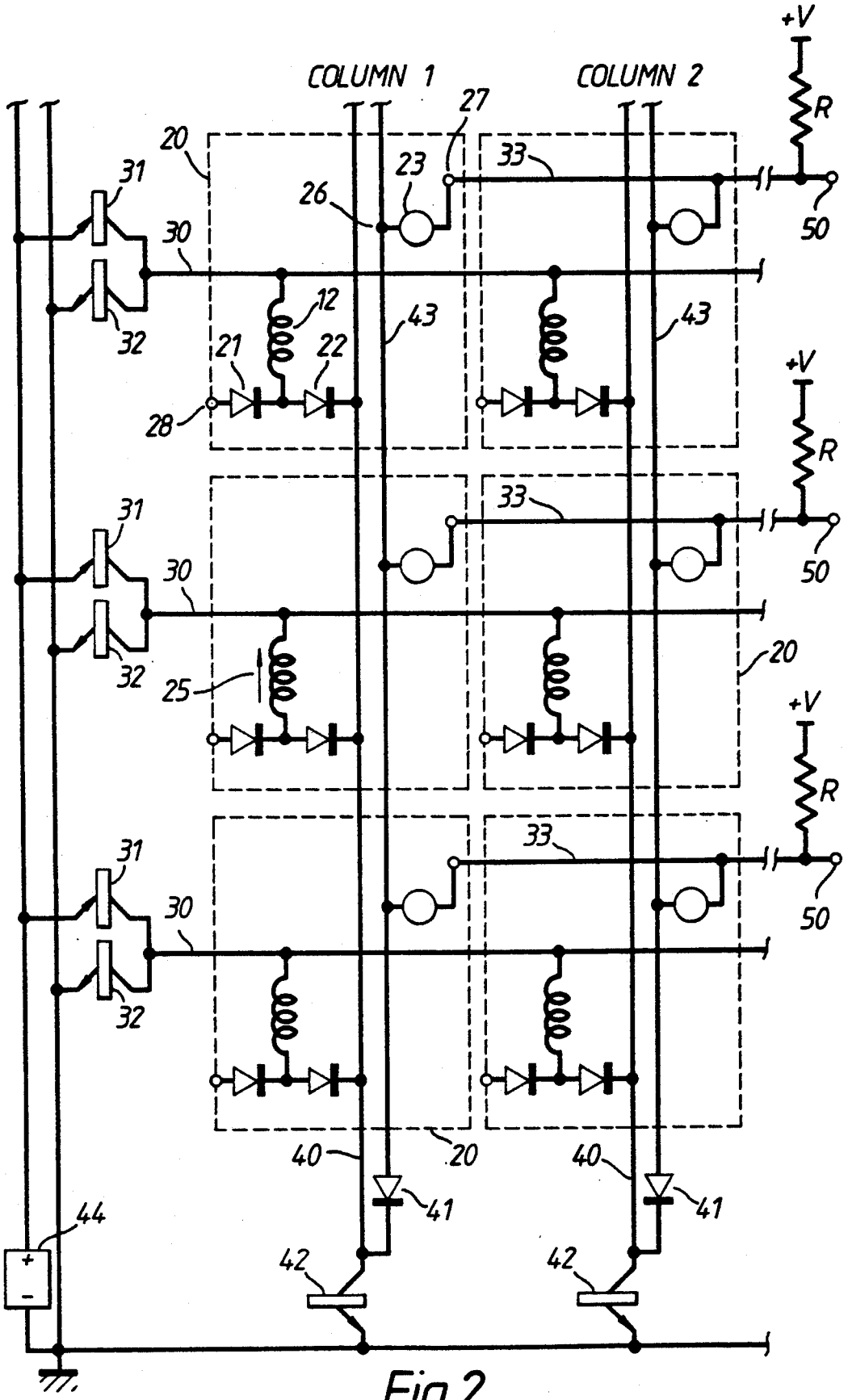
FIG. 2 illustrates a first preferred arrangement for interconnecting the display elements.

FIG. 2 illustrates an example of circuitry both for altering the states of display elements in a matrix display and for determining the states of the display elements. Each dotted rectangle 20 represents the circuitry associated with one display element.

As shown in FIG. 2 the circuitry associated with each display element comprises electromagnet winding 12 such as that shown in FIG. 1, diodes 21, 22 and a magnetically sensitive switch circuit 23.

The display elements are arranged in vertical and horizontal rows and a representative 3x2 portion of the matrix is shown.

Associated with each row of display elements is a first row conductor 30 and a second row conductor 33. Associated with each column of display elements is a first column conductor 40 and a second column conductor 43. The circuitry associated with the display matrix further comprises a dc voltage source 44 and transistors 31, 32 and 42. As can be seen from FIG. 2, PNP row transistors 31 are each connected between a respective first row conductor 30 and the positive terminal of voltage source 44. NPN row transistors 32 are each connected between a respective first row conductor 30 and the negative terminal of voltage source 44 or ground. The collector of each NPN column transistor 42 is connected directly to a respective first column conductor 40 and via a diode 41 to a respective second column conductor 43, and the emitter of transistor 42 is connected directly to ground. Each second row conductor 33 has a terminal 50, and is connected via a resistor R to a positive supply +V.

The circuitry within each display element 20 is arranged as follows. Magnetically sensitive switch circuit 23 having terminals 26, 27 is connected between respective second row conductor 33 and respective second column conductor 43. Diodes 21, 22 are connected in series between a terminal 28 and respective first column conductor 40, and electromagnet winding 12 is connected between the junction of diodes 21 and 22 and respective first row conductor 30.

Figure 3:
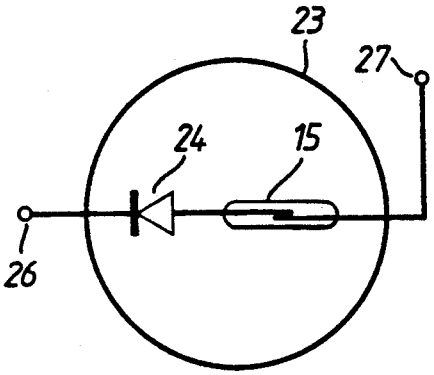
FIG. 3 illustrates a magnetically sensitive circuit.

Switch circuit 23 preferably comprises reed switch 15 as shown in FIG. 1 connected in series with a diode 24 as illustrated in FIG. 3.

An image is set up on the matrix display as follows. All of NPN row transistors 32 are turned ON hence connecting all of the first row conductors 30 to ground. Terminals 28 of display elements 20 are connected briefly by circuitry not shown to the positive terminal of power supply 44. Current therefore flows through diode 21, through winding 12 in the direction indicated by arrow 25 and through transistors 32 to ground. This energises windings 12 such that the display elements are set to the dark state of FIGS. 1*a* and 1*b*, thus blanking the matrix. To perform the above, terminals 28 can be energised all simultaneously, a group at a time or each in turn. After the matrix has been blanked NPN transistors 32 are turned OFF.

NPN transistor 42 associated with column 1 is turned ON together with selected PNP row transistors 31 corresponding to the row positions in column 1 in which the display elements are to be set to the bright state. Current flows from the positive terminal of power supply 44 through the selected row transistors 31, windings 12, diodes 22 and transistor 42 associated with column 1 to ground. The selected display elements are switched over to the bright state by the current flowing in windings 12 in the direction opposite to that shown by arrow 25. Transistor 42 associated with column 1 is then switched OFF and each of the remaining columns is dealt with in turn in the same manner as column 1 to complete the displaying of the image on the matrix.

It will be appreciated that it is equally possible to set up an image on the matrix display row by row following the blanking, as opposed to column by column as described above. To perform this, each PNP row transistor 31 is turned ON in turn together with selected NPN column transistors 42 corresponding to the display elements which are to be set to the bright state.

Once the image has been set up it may be read back for confirmation. For reading back all the row transistors 31, 32 are kept OFF and each column transistor 42 is switched ON in turn. When a particular column transistor 42 is turned ON its collector is grounded enabling current from potential +V to pass through those magnetically sensitive circuits 23 associated with the display elements in the selected column which are in the bright state. Thus when a particular column is selected by switching its column transistor 42 ON the status of its display elements can be determined from the voltage at the terminals 50 as follows. If a particular display element is in the dark state its associated switch circuit 23 is switched off and no current flows through the corresponding resistor R, and the voltage at the corresponding terminal 50 is equal to +V volts. If a particular display element is in the bright state its associated switch circuit 23 is switched on and current flows through the corresponding resistor R. The voltage at the corresponding terminal 50 is substantially less than +V volts, given that the value of R is great enough to ensure that the voltage drop across the resistor is significant compared to the combined voltage drop across switch circuit 23, diode 41 and transistor 42. The status of the display elements in each column may thus be determined from the voltages at terminals 50 by switching column transistors 42 ON sequentially.

Figure 4:
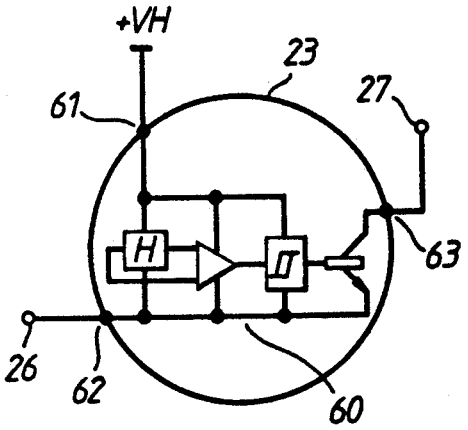
FIG. 4 illustrates a Hall Effect switch.
Figure 5A:
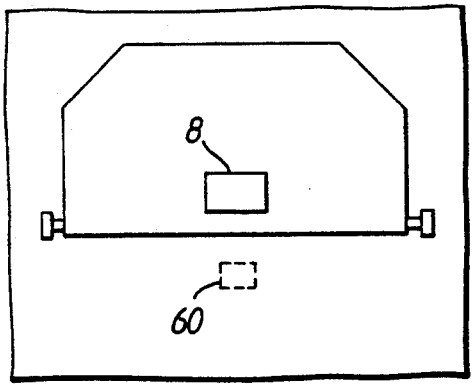
FIGS. 5*a,b* illustrate the positioning within a display element of a Hall Effect switch.
Figure 5B:
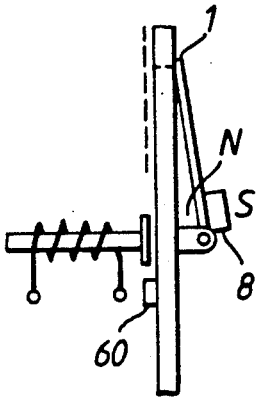

According to a further preferred embodiment magnetically sensitive switch circuit 23 is provided by a hall effect switch instead of the reed switch and diode illustrated in FIG. 3. FIG. 4 illustrates schematically a commercially available integrated circuit hall effect switch 60. This has a positive supply pin 61, a ground pin 62 and an output pin 63. The output transistor connected to pin 63 is turned ON only when power is applied across pins 61, 62 and the south pole of a magnet faces device 60. Pin 62 provides terminal 26 for the arrangement in FIG. 2 and pin 63 provides terminal 27. Current can flow between pins 27, 26 only in the direction towards pin 26, as was dictated by diode 24 in the arrangement in FIG. 3. At any given time the only hall effect switches which draw power from supply +VH are those connected to a column selected by turning ON the associated column transistor 42. FIG. 5 is similar to FIG. 1 and illustrates the positioning of hall effect switch 60 with respect to vane 1. When selected by column transistor 42, it is turned on only if vane 1 is in the bright position with the south pole of magnet 8 facing hall effect switch 60. It is turned off when vane 1 is in the dark position.

Figure 6:
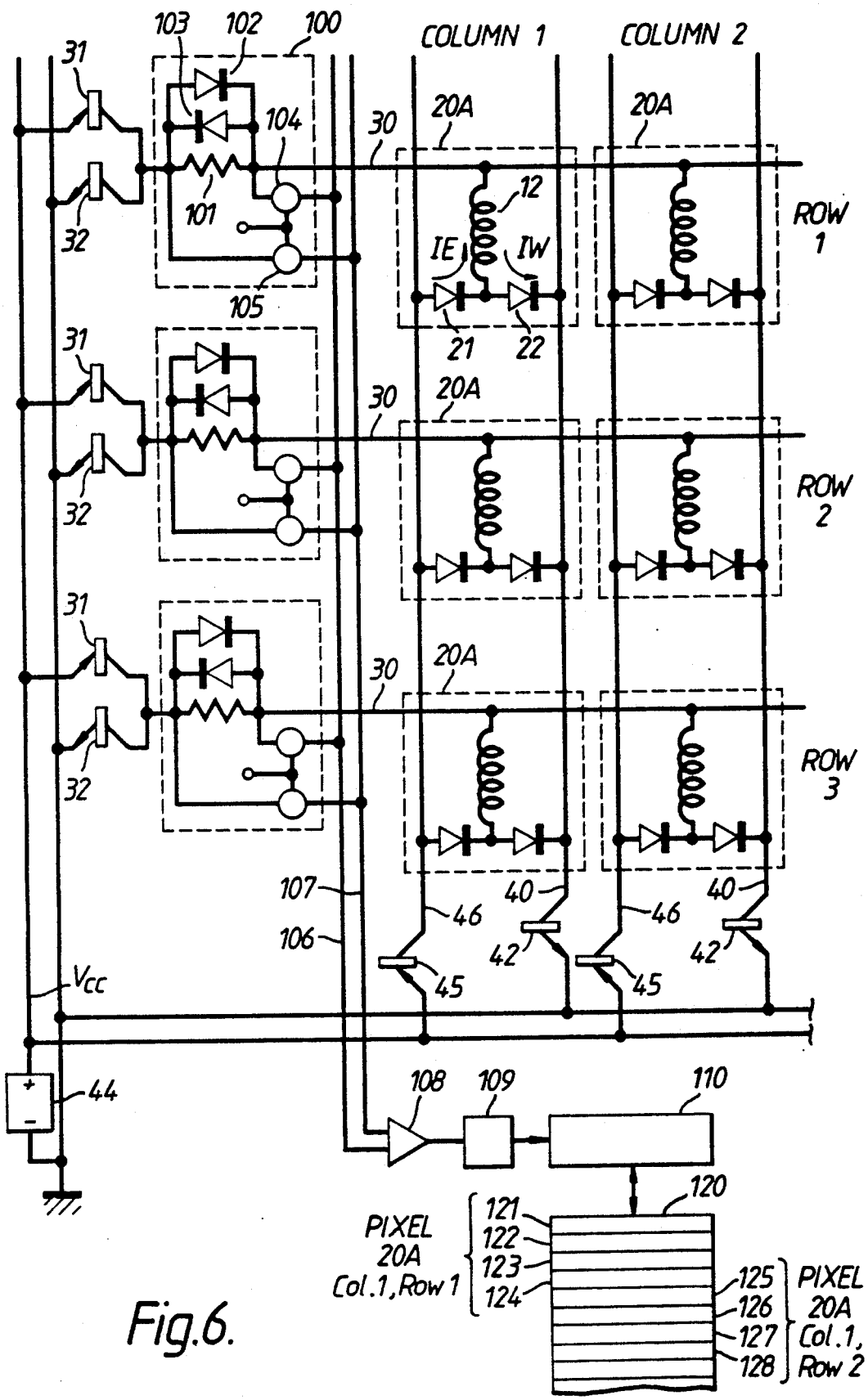
FIG. 6 illustrates a second preferred arrangement for interconnecting the display elements.

Diodes 41 in FIG. 2 serve to protect magnetic switch circuits 23 from the high voltages that may be used to drive the coils. The lifetime rating of hall effect switches 60 is increased by virtue of their being switched on for brief periods, instead of continuously. FIG. 6 illustrates an alternative display arrangement to that of FIG. 2 for sensing the statuses of the display elements. The circuitry of FIG. 6 will be discussed with reference to FIGS. 7, 8 and 9.

In FIG. 6 the display elements are represented by dotted rectangles 20A and are the same as the display elements 20 in FIG. 2 except that they have no magnetically sensitive switch 23. That is, the circuitry associated with each display element comprises electromagnet winding 12 such as that shown in FIG. 1 and diodes 21 and 22. Associated with each row of display elements is a row conductor 30, an NPN row transistor 32 and a PNP row transistor 31. As can be seen from FIG. 6, transistors 31 and 32 are connected in the same configuration with respect to power supply 44 as in the circuit of FIG. 2 except that they are not connected directly to row conductor 30, but via current monitoring circuit 100. Each row of the display has a current monitoring circuit 100 connected in series between respective row conductor 30 and row transistors 31, 32.

Each current monitoring circuit 100 comprises a resistor 1 01, diodes 102, 103 and analog switches 104, 105. The circuit is configured such that resistor 101 is connected in series between respective row conductor 30 and transistors 31, 32. Diodes 102, 103 are connected in parallel with resistor 101 and act to limit the voltage drop across resistor 101 when a large current flows between row conductor 30 and transistors 31, 32. Associated with the current monitoring circuits 100 are first and second monitoring conductors 106, 107 respectively. Analog switch 104 is connected between a first end of resistor 101 and first monitoring conductor 106. Analog switch 105 is connected between a second end of resistor 101 and second monitoring conductor 107.

Associated with each column of display elements are first and second column conductors 40 and 46 respectively and column transistors 42, 45. Each first column conductor 40 is similar to that in FIG. 2 and is connected via NPN transistor 42 to ground. Each second column conductor 46 is very different from the second column conductors 41 of FIG. 2. Each second column conductor 46 is connected via PNP transistor 45 to the positive terminal of power supply 44.

The circuitry within each display element 20A is arranged as follows. Diodes 21 and 22 are connected in series between respective second column conductor 46 and respective first column conductor 40. Electromagnet winding 12 is connected between the junction of diodes 21, 22 and respective row conductor 30. Arrow IE denotes the direction of current flow necessary through a display element winding 12 to urge that display element into the dark state. Arrow IW denotes the direction of current flow necessary through a display element winding 12 to urge that display element into the bright state.

It will be understood from the foregoing that the display elements in FIG. 6 can be set to display information in a similar manner to those in FIG. 2. In order to urge a particular display element into the dark state respective PNP column transistor 45 and NPN row transistor 32 are turned ON. This allows current to flow from the power supply 44 through second column conductor 46, diode 21, winding 12 in direction IE, row conductor 30, resistor 101 or diode 103 and to ground. In order to urge a particular display element into the bright state respective NPN column transistor 42 and PNP row transistor 31 are turned ON. This allows current to flow from the power supply 44 through resistor 101 or diode 102, row conductor 30, winding 12 in direction IW, diode 22, first column conductor 40 and to ground. The effect of resistor 101 and diodes 102, 103 in series with row conductor 30 is small enough not to affect the above described operation.

Thus the display elements and the mechanism by which they are driven in FIG. 6 is very similar to that in FIG. 2. However the arrangement for determining the status of the display elements is very different. The display element electromagnet cores in this embodiment are preferably of ferromagnetic material of low remanence.

The current monitoring resistors 101 of current monitoring circuit 100 each in series with a respective row conductor 30 have a value such that the current flowing through a single coil 12 produces a voltage of the order of 300 millivolts or less across a resistor 101. At this voltage silicon diodes 102, 103 are non-conductive. Resistor 101 is shunted with the two silicon diodes 102, 103, so as to limit the voltage drop across it when several coils in a given row are driven simultaneously. The voltage across a row resistor 101 can be selectively applied, by turning on its associated analog switches 104, 105 to current monitoring conductors 106,107. The operation of analog switches 104, 105 is under the control of a microprocessor 110, by way of connections not shown.

The apparatus of FIG. 6 further comprises a differential amplifier 108 having as inputs conductors 106,107, an analog to digital converter (ADC) 109 connected to the output of differential amplifier 108. Microprocessor 110 receives to the output of ADC 109. Microprocessor 110 has associated therewith a memory 120.

A selected pair of analog switches 104, 105 is operable therefore to apply the voltage across a respective resistor 101 to the inputs of differential amplifier 108 via conductors 106, 107. By way of ADC 109 the digital value of said voltage is input to microprocessor 110. As will be appreciated the voltage across a resistor 101 is proportional to the current flowing in the respective row conductor 30 up to a limit dictated by diodes 1 02, 1 03. In this way then microprocessor 110 can monitor and store in memory 120 the values of the currents flowing in row conductors 30, although only one current can be determined at a particular moment.

Figure 7:
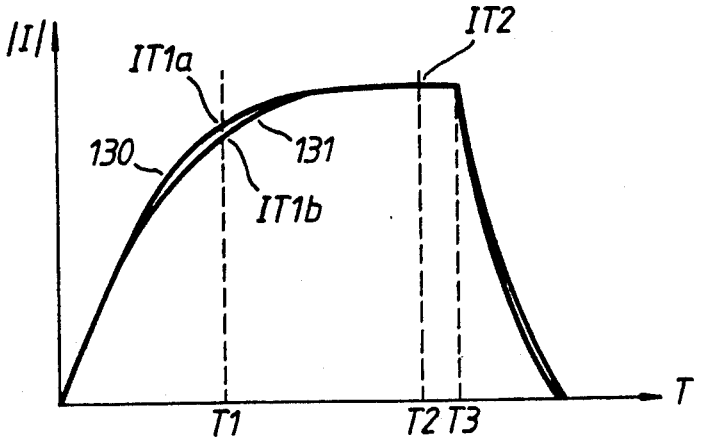
FIG. 7 illustrates the current flowing in the apparatus of FIG. 6 during inspection of a display element.

FIG. 7 illustrates how the magnitude of the current in coil 12 varies with time in response to a square voltage pulse of duration T3 applied across the coil in different circumstances. In the case where the flux due to permanent magnet 8 attached to vane 1 (FIG. 1) augments the flux due to the current in coil 12 the magnitude of the current varies according to curve 130. In the case where the flux due to permanent magnet 8 is in opposition to that due to the current in the coil 12 the magnitude of the current varies according to curve 131. The reason that the current rises faster in curve 130 is that, because of the augmentation of the flux, core 10 is driven further into saturation and therefore has a lower permeability, resulting in coil 12 having a relatively lower inductance. This difference is utilised in determining the optical states of the display elements.

Curve 130, having a current magnitude IT1*a* at time T1, corresponds to the case where the display element is being urged by pulse T3 into the visual state in which it is already, as this is the case where the flux due to the magnet 8 augments that due to the coil 12. Thus it corresponds to the case where a pulse in the "write" sense is applied and the display element already in the bright state and also to the case where the applied pulse is in the "erase" sense and the display element is already in the dark state.

Curve 131, having a current magnitude IT1*b* at time T1, corresponds to the case where the display element is being urged by pulse T3 into the visual state opposite to that in which the display element is already, as this is the case where the flux of the magnet 8 opposes that due to the coil 12. Thus it corresponds to the case where a pulse in the "write" sense is applied and the display element is in the dark state and also to the case where the pulse is in the "erase" sense and the display element is in the bright state.

The correlation between the sense of the applied pulse T3, the state of the display element and the magnitude of the current at T1 is summarised in the table in FIG. 8.

The difference between IT1*a* and IT1*b* can be of the order of ten percent. The difference depends on the extent to which the coil current saturates core 10 and on the strength of the magnet 8 and the extent to which its flux alters the saturation of the core.

A method of sensing the visual state of a selected display element, the display element 20A in row 1 and column 1, for example, using the current difference described above is now described. A pulse of short duration T3 and in the "write" direction is applied to the display element winding 12 by turning on respective transistors 31, 42, causing current IW to flow. T3 is chosen to be so brief as to be incapable of altering the state of the display element, typically a few milliseconds. At instant T1 within the pulse the value of the current is sampled by microprocessor 110 and stored in memory location 121. This value will be IT1*a* if the display element is in the bright state and IT1*b* if the display element is in the dark state. At instant in T2 within the pulse the steady state amplitude IT2 of the current is also sampled and it is stored in memory location 122. After termination of the pulse, another pulse of the same duration T3 but of opposite sense is applied to the same display element by means of respective transistors 45, 32; passing current IE. Current IE is sampled at instant T1 within the pulse and also when it has reached the steady state at T2, and these two values are stored in locations 123, 124 respectively.

In the ideal case where diodes 21, 22 are matched; transistors 31, 45 are matched; and transistors 32, 42 are matched, then exactly the same magnitude of voltage is applied across coil 12 during the "write" sense pulse as in the "erase" sense pulse. Hence the steady state values held in memory locations 122, 124 will be identical, being the magnitude of the voltage applied across coil 12 divided by the resistance of coil 12. However, the contents of memory locations 121, 123 will be different form each other., They will be IT1*a*, IT1*b* respectively if the display element is in the bright state and IT1*b*, IT1*a* respectively if the display element is in the dark state. This is summarised in the table in FIG. 15.

Thus, using brackets to denote "contents of",:

$$\frac{(121)}{(123)} > 1$$ Indicates that the display element is in the bright state.

$$\frac{(121)}{(123)} < 1$$ Indicates that the display element is in the dark state.

In practice however the diodes will vary in characteristics one from another as will the transistors, causing the voltage across coil 12 not to be exactly the same for the "write" sense as for the "erase" sense. There can be a difference of several per cent in these two values. It is for this reason that the steady state values of the positive and negative pulses are recorded in locations 122, 124 respectively. The ratio of the contents of these locations provides a correction factor suitable for more accurately discerning the state of the display element, taking into account the affect of variations in semiconductor characteristics on current magnitude. Thus in general:

if $\frac{(121)}{(123)} \div \frac{(122)}{(124)} > 1$ then the display element is in the bright state;

and if $\frac{(121)}{(123)} \div \frac{(122)}{(124)} < 1$ then the display element is in the dark state.

To determine the states of all the display elements in a column it is possible to drive all the display elements in the column simultaneously in the "write" sense for period T3, then drive all pixels in the column simultaneously in the "erase" sense for period T3. At about times T1, T2 for each pulse T3 the row currents are sampled in rapid succession and the values stored in memory 120. After completion of the two pulses T3 microprocessor 110 analyses the values in memory and determines the states of all the display elements in the column.

Alternatively, the apparatus of either FIG. 2 or FIG. 6 may be arranged simply to determine whether the display elements of the matrix alter their state when required, without actually determining which optical state the display elements are in.

An object of sensing the states of the display matrix either by way of apparatus as shown in FIG. 2, or FIG. 6, or by any other means can be to warn an operator, who may be remote from the display matrix and in charge of several other matrixes, that the matrix is not functioning correctly. In this case the operator may choose to cause the faulty matrix to be blanked (i.e. erased) and he can request that a maintenance engineer be sent to the display matrix to correct the fault. This is not an ideal solution as the display matrix is put out of action for some time and there is the expense of sending an engineer promptly to mend the fault.

There will now be described with reference to FIGS. 10–16 apparatus and methods which provide a more satisfactory solution that minimises the detrimental effects of faults in the display, and reduces the probability of a faulty matrix having to be switched off or promptly repaired.

Figure 10:
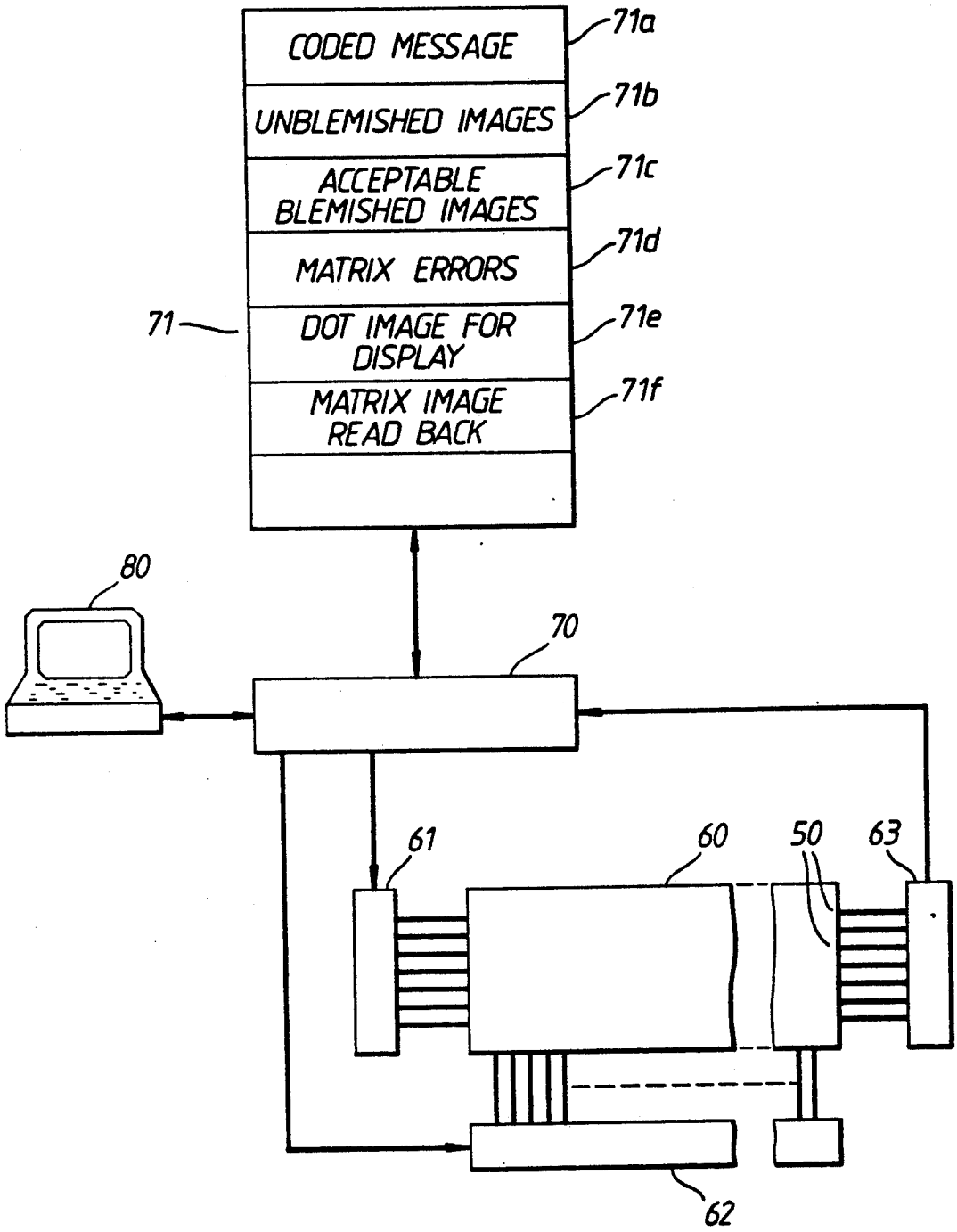
FIG. 10 illustrates preferred apparatus embodying an error correction system according to this invention.
Figure 11A:
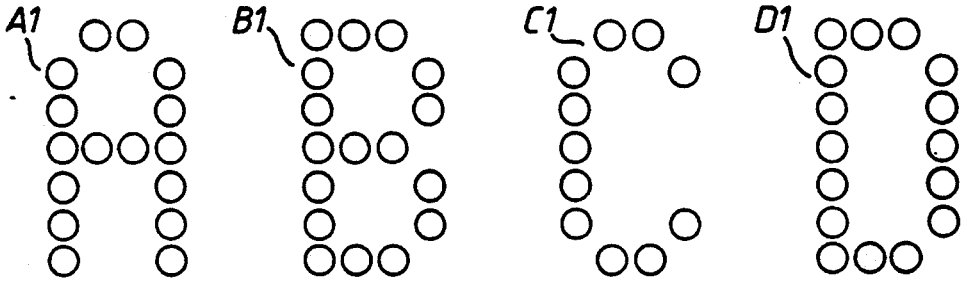
FIG. 11*a*–11*d* illustrate exemplary character images used by the error correction system of FIG. 6.
Figure 11B:
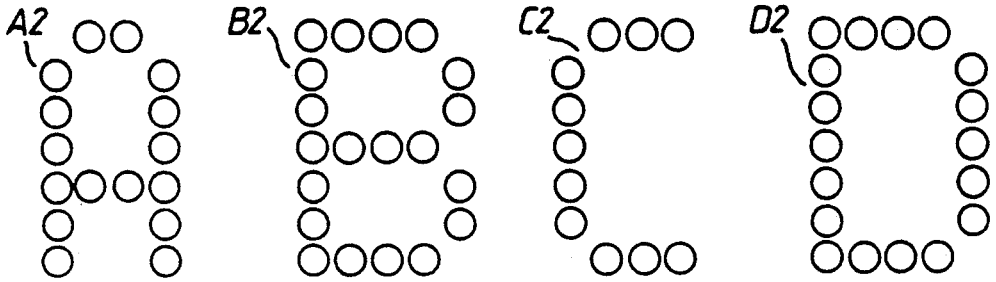
Figure 11C:
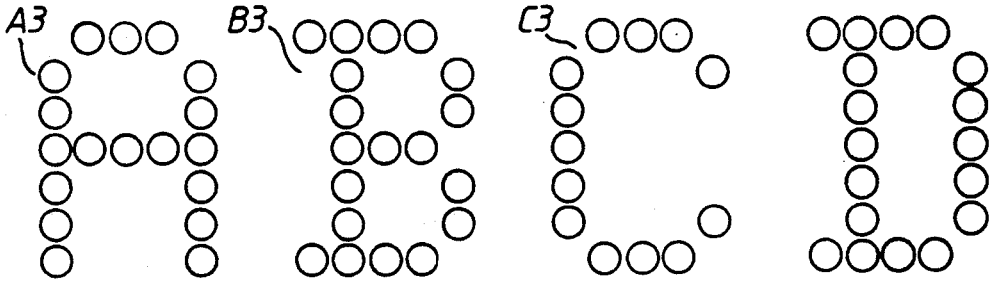
Figure 11D:
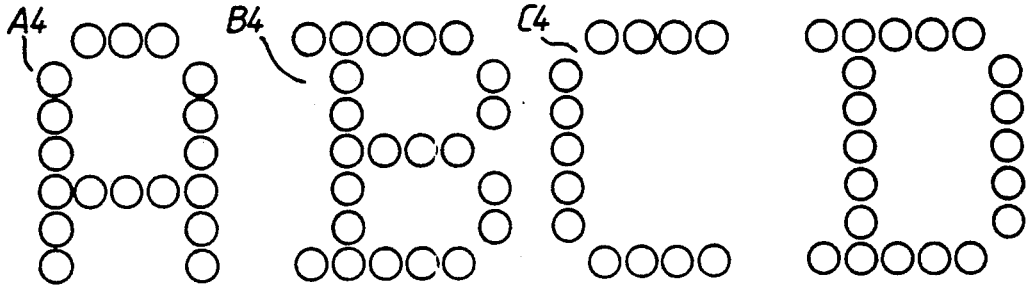

FIG. 10 illustrates a display system comprising a matrix display 60, a microprocessor 70 having an associated memory 71 divided into several sections as described below, and an operator console 80. The matrix display 60 may be largely as described with relation to FIG. 2. In this case composite row driver 61 comprises the row transistors 31, 32 of FIG. 2 and composite column driver 62 comprises the column transistors 42 of FIG. 2 and these drivers are controlled by microprocessor 70. Composite driver 62 is also operable to apply drive signals to the blanking terminals such as terminals 28 in FIG. 2 under the control of microprocessor 70. Unit 63 comprises terminals 50 and resistors R of FIG. 2 and receives pixel status information from matrix display 60 which it transmits to microprocessor 70.

Alternatively the matrix display 60 may be largely as described with relation to FIG. 6. In this case composite row driver 61 comprises the row transistors 31, 32 of FIG. 6 and composite column driver 62 comprises the column transistors 42, 45 of FIG. 6. The arrangement of FIG. 10 in this case would also comprise current monitoring circuits 100 and amplifier 108, ADC 109 and microprocessor 110, which are not shown in FIG. 10. These provide information regarding the states of the display elements to microprocessor 70, and it may be that microprocessor 70 comprises microprocessor 110.

According to a preferred embodiment illustrated in FIG. 10, a message to be displayed on matrix display 60 originates in coded form, taking one byte for each character, from a message source such as operator console 80 which may be remote from matrix display 60. The coded message is received by microprocessor 70 and stored in portion 71*a* of memory 71 which is associated with microprocessor 70. The coded message is then converted by microprocessor 70 into a dot image for display and this dot image of the message is stored in memory portion 71*e*. The dot image in 71*e* is then written by microprocessor 70 onto matrix 60, by appropriate selection of the row and column conductors in the matrix, for example as was described with reference to FIG. 2 or FIG. 6. After writing, the status of the display elements is read back for example as was described with reference to FIG. 2 or FIG. 6 by microprocessor 70 and stored in memory area 71*f*. The contents of areas 71*e*, 71*f* are compared. If they match then the information displayed on matrix 60 is correct.

If a pixel error is detected in matrix 60, by finding a mismatch between the contents of memory areas 71*e* and 71*f*, the pixel error is recorded in area 71*d* specifying the column and row positions of the pixel together with an indication of whether the fault is that the pixel will not switch from the dark state to the bright state or vice versa.

Pixel errors may be discovered in the normal course of writing messages on the display and reading back the pixel states. In this case the information in memory area 71*d* may be continuously updated. Alternatively, pixel errors may be determined by way of performing a test sequence. An appropriate test sequence would be to attempt to set all the pixels of matrix 60 to the bright state and read back matrix 60 so as to detect and record pixels that are sticking in the dark state; and then to attempt to set all the pixels of matrix 60 to the dark state and read back matrix 60 so as to detect and record pixels that are sticking the bright state. In this case the information in memory area 71*d* would be complete before any messages were displayed.

The following description is of a preferred embodiment of a method according to the present invention which minimises the effect of faulty pixels on the intelligibility of characters displayed on a matrix display. It is assumed that this method has at its disposal a record of the known faulty pixels. Such a record may be established as described above, either by way of a test sequence or continuous updating or a combination of both performed by the display system itself, or it may be established by a manual method. Such a manual method may involve an operator watching the display in operation and entering into the display system information representative of the faults in the display.

According to this method there is defined a set of dot images or pixel patterns corresponding to each possible coded alphabetic or numeric character which is available for display, illustrated in FIG. 11. For each coded character there is according to this embodiment a preferred image for the character, illustrated in FIG. 11*a*, and a number of alternative images of the same height but of different shapes all of which are clearly recognisable and unblemished, illustrated in FIGS. 11*b*, *c* and *d*.

FIG. 11 shows alternative dot images only for the characters "A", "B", "C" and "D" although it is understood that there is envisaged a corresponding set for each character which is available for display and that there may be fewer than or more than three alternative unblemished images for each character.

Figure 12:
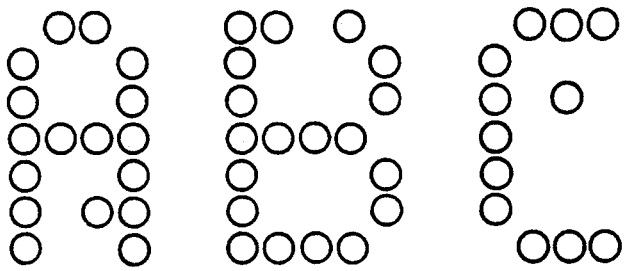
FIG. 12 illustrates further character images used by the error correction system of FIG. 6.

There is also defined a set of images corresponding to each coded character which contain pixel blemishes which, though aesthetically undesirable, do not render the character ambiguous or difficult to recognise. FIG. 12 illustrates by way of example some such characters.

Figure 13:
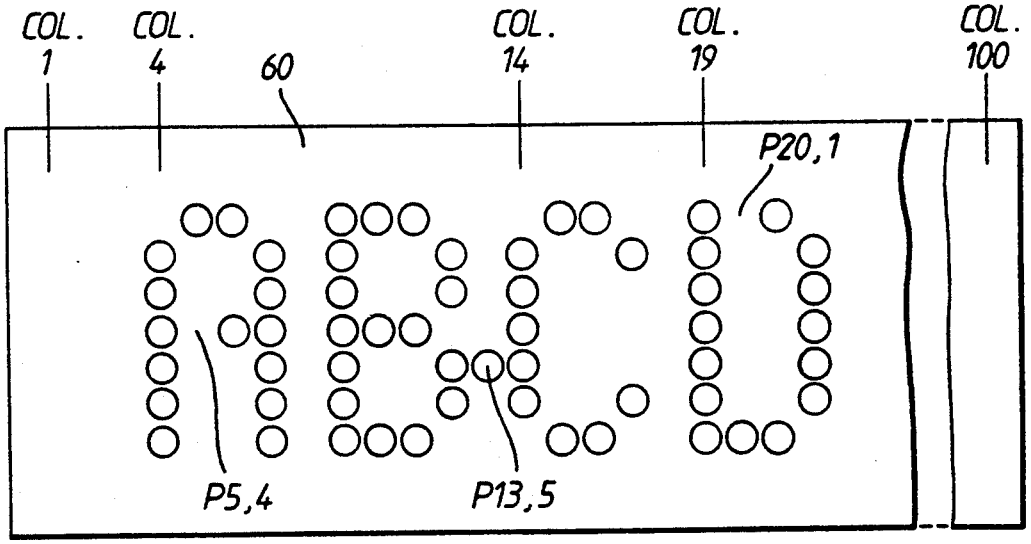
FIG. 13 illustrates a corrupted message.
Figure 14:
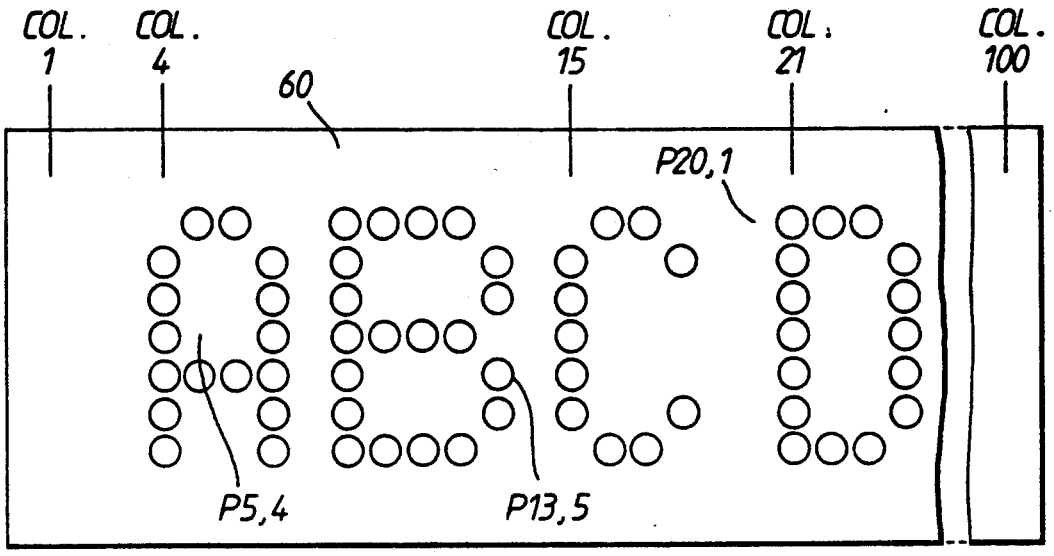
FIG. 14 illustrates the same message as in FIG. 13 showing the effect of the method of this invention.

With reference to FIGS. 13 and 14 there will now be described possible faults which may occur in a matrix display and the method by which the effect of these faults may be minimised. In the embodiment shown in FIG. 10 such a method would be performed by microprocessor 70. In the example described, the sequence of letters "A B C D" is to be displayed.

It is assumed for the sake of explanation that the matrix display shown in FIGS. 13 and 14 has three faulty pixels, i.e. display elements, namely P5,4; P13,5; P20,1, where Pc,r denotes the pixel in column c and row r, and that these faults are previously known. Of the faulty pixels P5,4 and P20,1 are assumed not to be switching in response to matrix drive signals and permanently in the dark state and P13,5 is assumed not to be switching in response to matrix blanking signals and permanently in the bright state. FIG. 13 illustrates the appearance of the characters A B C D when recorded for instance on the matrix display having the above described faults, beginning at column 4 and using the preferred character images A1, B1, C1 and D1 shown in FIG. 11*a*. In this case all four letters appear blemished.

The method of this invention ameliorates the blemishing of the letters by masking the blemishes in the characters. This masking is achieved by writing on the matrix display alternative character images which have pixels in the bright state overlapping pixels in the matrix display that are permanently in the bright state and which have pixels in the dark state overlapping pixels in the matrix display that are permanently in the dark state. As well as selecting alternative images or as an alternative, the method may also alter the spacing between the characters, preferably by shifting the character positions one or two columns to the left or right in order to mask the faulty pixels in matrix 60.

Figure 16:
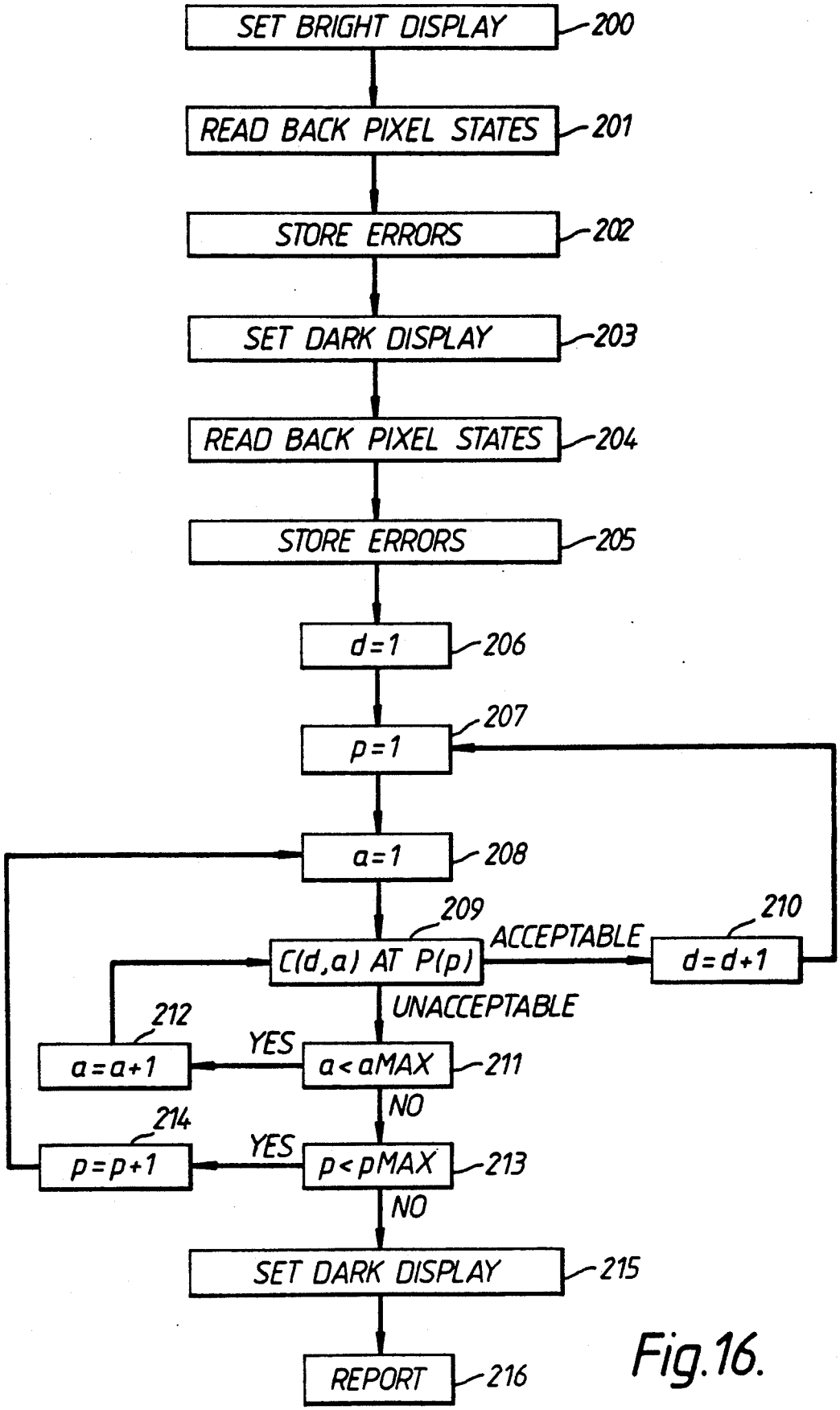
FIG. 16 illustrates in flow chart form a preferred method of this invention.

FIG. 16 illustrates in flow chart form a particularly preferred embodiment of the above described method. In this embodiment the record of faulty pixels is established by a test sequence as mentioned above. In step 200 all the pixels of the display are set to be bright and the errors in the display are read back and stored (steps 201 and 202). Similarly in step 203 all the pixels of the display are set to be dark and the errors in this display are read back and stored (steps 204 and 205). Thus there is established a complete record of all the faulty pixels.

According to the notation of FIG. 16, each of the characters to be displayed are assigned a number "d". Thus for the first character to be displayed, d=1, for the second, d=2, etc. The number "a" represents the alternatives available for each character to be displayed, for instance those illustrated in FIGS. 11 and 12. Thus C(d, a) is the notation for the $a^{th}$ alternative of the $d^{th}$ character to be displayed. If there were 4 alternatives for a particular character, a may equal 1, 2, 3 or 4 and aMAX=4. The number "p" is representative of the positions on the display available for a character to be displayed. Thus if a character may be acceptably displayed in three positions p may equal 1, 2 or 3, and pMAX=3. P(p) is the notation for the $p^{th}$ position. In FIG. 16*d*, *p* and *a* are all initialised to equal 1 in steps 206 to 208.

At step 209 the method assesses the acceptability of C(d, a) at P(p). Thus the first time this step is reached the acceptability of the first alternative of the first character to be displayed in position 1 is assessed. This assessment is based, as described above, on whether the faulty pixels in the display alter the pixel patterns of the character. A particular character alternative is deemed acceptable at a particular position if the pixel pattern is not affected by the faulty pixels. If C(1, 1) is acceptable at P(1) then d is incremented at step 210 and the process returns to step 207, now considering the next character to be displayed.

As can be seen from FIG. 16, the method repeats steps 209, 211 and 212 incrementing "a" until an acceptable alternative .pixel pattern is found. If aMAX is reached without any alternative being acceptable then p is incremented, a is set back to 1 and all the alternatives are considered in the next display position. This is repeated (steps 213 and 214) until pMAX is reached or until an acceptable alternative is found at step 209.

If step 213 is reached and p=pMAX then all the allowable alternatives of a particular character to be displayed have been assessed in all of the allowable display positions without an acceptable display being found because of the pixel faults. Thus this particular character cannot be acceptably displayed. Under these circumstances many courses of action may be taken.

In the embodiment of FIG. 16 the action taken when there are so many faulty pixels that a particular character cannot be displayed is to set all of the pixels in the display to be dark (step 215) and to report (step 216) that it is not possible to display the required characters. Following this it may be that the display has to be repaired. Alternatively or in addition there may be routines which are followed which attempt to display different characters, but which convey basically the same information.

For instance, if the particular display is a road sign, on which a speed limit is to be displayed, it may be if it is found that "40" cannot be acceptably displayed, that "39" will be displayed instead.

In the embodiment of FIG. 16, the selection of the alternatives and positions for display is performed by considering each alternative at a particular position before considering another display position. This selection may, of course, be performed in other ways, for instance by considering a particular alternative at all the available positions before considering the other alternatives or by combining these two. For example the method may assess the acceptability of unblemished pixel patterns, such as shown in FIG. 11 in all available positions, before assessing blemished patterns, such as shown in FIG. 12. Also it may be that in a particular circumstance, no alternative pixel patterns are acceptable or no alternative positions are acceptable, and in these cases the method would only assess alternative positions or alternative pixel patterns, respectively. These may be implemented by the flow chart of FIG. 16 by setting aMAX or pMAX equal to 1.

FIG. 14 shows the dot image formed by the method of this invention which takes into account the errors P5,4; P13,5; P20,1. This dot image uses image A2 in FIG. 11*b* instead of A1 as A2 has a lower bar than A1 and hence is unblemished by the dark pixel P5,4. This may also be considered as masking faulty pixel P5,4. Image B2 which is five pixels wide is used instead of B1 which is only four pixels wide as this masks the faulty permanently bright pixel P13,5. Because B2 is one pixel wider than B1, the images for C and D must be moved one pixel to the right in order to leave a space of one pixel between letters B and C. Image C1 is used as there are no blemishes in the area of matrix 60 where it will now be placed. For the letter D there are no alternative images suitable for masking permanently dark pixel P20,1 and in this case image D1 is chosen but is positioned one further column to the right leaving permanently dark pixel P20,1 in the space between letters C and D. When the message thus prepared is written onto the matrix display, the display appears to have no errors.

If it is not possible using the above method to complete a message image using unblemished images from FIG. 11, because there are too many errors, the method attempts to complete the message using the blemished but acceptable images illustrated in FIG. 12 as well. Though the resulting image will have blemishes there is still the assurance that the message is readable and that no character is so corrupted as to be mistaken for a different one.

According to a preferred embodiment of this invention the above described method of displaying information is implemented in the apparatus illustrated in FIG. 10. In this case, matrix display 60 corresponds to the matrix display of FIGS. 13 and 14.

As described previously, pixel errors may be detected in matrix display 60 by comparing the contents of memory areas 71*e* and 71*f* associated with microprocessor 70. Such pixel errors are stored in memory area 71*d*. Memory 71 also has stored in area 71*b* the preferred and alternative unblemished dot images such as shown in FIG. 11 and in area 71*c* the acceptable but blemished dot images such as shown in FIG. 12.

Having the information thus stored in memory 71 microprocessor 70 performs the above described method to select which particular dot images from memory areas 71*b* and 71*c* should be used and to select their precise positions on the matrix display, as described above in relation to FIG. 14. The selection is performed in order to mask the previously identified faulty pixels. The image thus prepared is stored in memory area 71e and displayed on matrix display 60.

In addition to the preferred apparatus illustrated in FIG. 10, it is envisaged that there may be alternative apparatus which could carry out the method of this invention.

Figure 15:
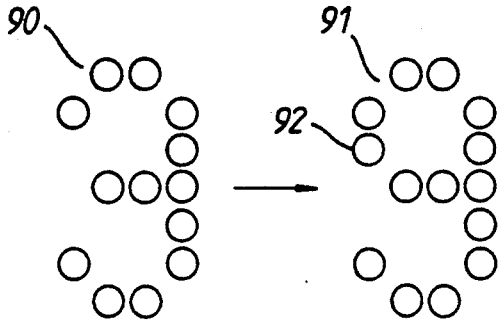
FIG. 15 illustrates the relationship between character images used in this invention.

FIG. 15 illustrates the protection provided by this invention against a character being blemished so as to be misleading. Single pixel error 92 converts the image 90 for the number 3 into an image 91 for the number 9 as shown in FIG. 15. Protection is provided against such misleading information being displayed because the image 91 does not exist according to the method of the invention as an acceptable image for the number 3. The only way it can appear on matrix 60 is if pixel 92 fails during writing the number 3. In this case the error is detected by the displayed image being read back and compared with the required display. Matrix 60 is consequently blanked and a new message image, now taking into account recent error 92, is then written and checked. Thus, in general the set of acceptable alternatives for a particular character does not include any pixel pattern which may be read as a different character.

If it is not possible to complete a message even relying on the blemished acceptable patterns in FIG. 12 the display may be blanked in order that no information, which may be misleading, is displayed.

In the embodiment of FIG. 10 microprocessor 70 can be arranged to report daily to the operator the number of errors in matrix 60. It can also report if the system has resorted to using the images of FIG. 12 stored in memory area 71c to function and if the matrix is blanked as described above. The operator can then make a decision about having the faults repaired.

The error management system described is applicable to matrixes using other display elements than that of FIG. 1, providing a read back facility is provided that indicates the actual states of the pixels. Thus, for example, the error management system can be used for a light bulb matrix providing each light bulb is provided with means indicating whether it is the bright or dark state, such as a current sensor in series with the bulb.

Though the error management system described gives a high degree of security against pixel errors it is nevertheless important that the pixels themselves be highly reliable, so that the probability of there being even two or three pixel errors is kept very low. For this reason electromagnetic pixels such as that illustrated in FIG. 1 are preferable to light bulb pixels, which are known to fail after a few thousand hours of operation.

I claim:

1. An information display system, comprising a matrix of display elements, each of said display elements being switchable between first and second optical states of contrasting appearance, said display system further comprising drive means for altering the optical states of said display elements to portray a pattern on said matrix, and storage means for recording the optical states of display elements failing to change their optical states in response to said drive means, said system further comprising input means for inputting a coded character to be displayed on said matrix; and display means responsive to both said storage means and said input means for detecting the presence of a non-responsive display element in the portion of the matrix on which said character is to be displayed, said display means comprising conversion means for converting said coded character into a selected one of a plurality of alternative dot matrix images representative of said character, the selection of one of said alternative images mitigating the effect of said non-responsive display element on the intelligibility of the character displayed.

2. An information display system, comprising:

a matrix of display elements, each of said display elements being switchable between first and second optical states of contrasting appearance;

said display system further comprising drive means arranged to alter the optical states of said display elements to portray a pattern on said matrix;

monitoring means for detecting a characteristic indicative of the optical states of the display elements;

input means for inputting a code representing a character to be displayed on said matrix; and display means for detecting the presence of a display element in the portion of the matrix on which said character is to be displayed and being non-responsive to said drive means and to detect whether or not said non-responsive element is in said first state, said display means comprising conversion means adapted to convert said code into a selected one of a plurality of alternative dot matrix images representative of said character, the selected one of said alternative images mitigating the effect of said non-responsive display element on the intelligibility of the character displayed.

3. A display system to claim 2, wherein said plurality of alterative dot matrix images comprises a preferred image and at least one alternative unblemished image.

4. A display system according to claim 3, wherein said plurality of alternative dot matrix images further comprises at least one blemished but recognizable image.

5. An information display system according to claim 2, further including means for inputting a code representing a character to be displayed on said matrix and memory means for storing a plurality of alterative dot matrix images for said character, said system reporting that the matrix is unusable in the event that it is not possible to display a message containing said character by portraying said character in the form of any of said alternative dot matrix images.

6. An information display system, comprising:

a matrix of display elements, each of said display elements being switchable between first and second optical states of contrasting appearance;

said display system further comprising drive means arranged to alter the optical states of said display elements to portray a pattern on said matrix;

monitoring means for detecting a characteristic indicative of the optical states of the display elements;

input means for inputting a code representing a character to be displayed on said matrix;

conversion means for converting said code into a dot matrix image representative of said character; and display means for detecting the presence of a display element in the portion of the matrix in which said character is to be displayed and being non-responsive to said drive means, said display means being adapted to select a position on said portion for display of said image to mitigate the effect of said non-responsive display element on the intelligibility of the character displayed.

7. An information display system, comprising:

a matrix of display elements, each of said display elements being switchable between first and second optical states of contrasting appearance, each display element including a member movable between first and second positions to provide said first and second optical states, and each said display element comprising a permanent magnet for moving when said member moves;

said display system further comprising drive means arranged to alter the optical states of said display elements to portray a pattern on said matrix, said drive means including actuating electromagnets the magnetic fields of which cause movement of said movable members; and monitoring means for detecting a characteristic indicative of the optical states of the display elements in the form of magnetic field sensing means for sensing the positions of said movable members by sensing the fields of said permanent magnets, and said monitoring means detecting failure of movable member to move from one to the other of said positions in response to the magnetic field of the associated actuating electromagnet.

8. A display system according to claim 7, wherein said electromagnets have cores of low remanence and are positioned close to said permanent magnets and wherein said field sensing means comprises means for sensing changes in the electrical characteristics of said electromagnets caused by fields of said permanent magnets.

9. A display system according to claim 7, wherein said monitoring means comprises reed switches.

10. A display system according to claim 7, wherein said monitoring means comprises hall effect switches.

11. A display system according to claim 7, wherein said electromagnets have cores of magnetic material of low remanence.

12. A display system according to claim 11, wherein said movable members rotate.

13. A display system according to claim 7, wherein said drive means alters the optical states of said display elements to prevent faulty display elements from being energized.

14. An information display system, comprising:

a matrix of display elements, each of said display elements being switchable between first and second optical states of contrasting appearance;

drive means for altering the optical states of said display elements to portray a pattern on said matrix;

means defining the positions within said matrix of display elements failing to change from one to the other of said optical states in response to said drive means;

input means for inputting a coded character to be displayed on said matrix; and display means responsive to both said position-defining means and said input means for detecting the presence non-responsive display element in the portion of the matrix on which said character is to be displayed, said display means comprising conversion means for converting said coded character into a selected one of a plurality of alternative dot matrix images representative of said character, the selection of one of said alternative images mitigating the effect of said non-responsive display element on the intelligibility of the character displayed.

15. An information display system, comprising:

a matrix of display elements, each of said display elements being switchable between first and second optical states of contrasting appearance;

drive means for altering the optical states of said display elements to portray a pattern on said matrix;

means defining the positions within said matrix of display elements failing to change from one to the other of said optical states in response to said drive means; and display means responsive to said position-defining means for detecting the presence of a display element in the portion of the matrix in which a character image is to be displayed and being nonresponsive to said drive means, said display means selecting a position on said portion for display of said character image to mitigate the effect of said nonresponsive display element on the intelligibility of the character displayed.

16. An information display system, comprising:

a matrix of display elements, each of said display elements being switchable between first and second optical states of contrasting appearance;

drive means for altering the optical states of said display elements to portray a pattern on said matrix;

means defining the positions within said matrix of display elements failing to change from one to the other of said optical states in response to said drive means;

input means for inputting a coded character to be displayed on said matrix; and display means responsive to both said position-defining means and said input means for detecting the presence of non-responsive display elements in the matrix, said display means comprising conversion means for converting said coded character into a selected one of a plurality of alternative dot matrix images representative of said character, the selection of one of said alternative images mitigating the effect of said non-responsive display element on the intelligibility of the character displayed.

* * * * *